US010145536B1

(12) United States Patent
Porciatti

(10) Patent No.: US 10,145,536 B1
(45) Date of Patent: Dec. 4, 2018

(54) INDIRECT LED LIGHTING SYSTEM FOR A SUSPENDED CEILING

(71) Applicant: JLC-Tech IP, LLC, Weston, FL (US)

(72) Inventor: Silvio Porciatti, Pembroke, MA (US)

(73) Assignee: JLC-Tech IP, LLC, Weston, FL (US)

( * ) Notice: Subject to any disclaimer, the term of this patent is extended or adjusted under 35 U.S.C. 154(b) by 0 days.

(21) Appl. No.: 15/973,823

(22) Filed: May 24, 2018

(51) Int. Cl.

| | |
|---|---|
| ***F21S 8/06*** | (2006.01) |
| ***F21V 7/00*** | (2006.01) |
| ***F21S 8/04*** | (2006.01) |
| ***F21V 29/76*** | (2015.01) |
| *F21Y 115/10* | (2016.01) |

(52) U.S. Cl.
CPC ..... *F21V 7/0008* (2013.01); *F21S 8/043* (2013.01); *F21S 8/06* (2013.01); *F21V 29/767* (2015.01); *F21Y 2115/10* (2016.08)

(58) Field of Classification Search
CPC .... F21S 2/007; F21S 6/008; F21S 8/04; F21S 8/033; F21S 8/06; F21S 8/063; F21V 7/00; F21V 7/005; F21V 7/0008; F21V 7/0016; F21V 13/04; F21V 29/004; F21V 29/70; F21V 29/74; F21Y 2103/10; F21Y 2105/10
See application file for complete search history.

(56) References Cited

U.S. PATENT DOCUMENTS

| | | | | |
|---|---|---|---|---|
| 1,913,377 | A * | 6/1933 | Dorey | F21S 13/00 362/309 |
| D162,843 | S | 4/1951 | Klein | |
| 4,126,971 | A | 11/1978 | Macuga | |
| 4,230,900 | A | 10/1980 | Speet | |
| 4,794,745 | A | 1/1989 | Platt | |
| 4,972,339 | A | 11/1990 | Gabrius | |
| D315,832 | S | 4/1991 | Rocheleau | |
| D338,449 | S | 8/1993 | Sahyoun | |
| 5,313,759 | A | 5/1994 | Chase, III | |
| 5,454,756 | A | 10/1995 | Ludwig | |
| 5,613,759 | A | 3/1997 | Ludwig | |
| 5,687,527 | A | 11/1997 | Bikard | |
| D394,595 | S | 5/1998 | Walsh | |
| 5,848,833 | A * | 12/1998 | Margulies | F21S 8/06 362/147 |
| 6,220,721 | B1 | 4/2001 | Chan | |

(Continued)

FOREIGN PATENT DOCUMENTS

KR 20-0447421 Y1 1/2010

*Primary Examiner* — Hargobind S Sawhney
(74) *Attorney, Agent, or Firm* — Heisler & Associates

(57) ABSTRACT

A T-bar type support extends in elongate form and is configured, such as with a spine and rest shelf, for supporting edges of ceiling tiles thereon within a suspended ceiling system. A lighting module is suspended below other portions of the T-bar. The T-bar also includes a reflector plate above the body which extends at least partially laterally and below where the ceiling tiles are supported. A lighting source within the lighting module shines light upwardly which then reflects off of the reflector plate and down into an interior space beneath the suspended ceiling. Legs preferably suspend the lighting module below the reflector plate, with the legs preferably at ends of the T-bar, and with open space between the legs, so that nothing obstructs light shining from the lighting source up against the reflector plate and then down into the interior space beneath the ceiling.

20 Claims, 6 Drawing Sheets

(56) References Cited

U.S. PATENT DOCUMENTS

D445,211 S 7/2001 Baker
D488,243 S 4/2004 Babka
7,383,670 B1 6/2008 Meyers
D581,376 S 11/2008 Shaner
7,621,497 B2 11/2009 Wallace
D606,501 S 12/2009 Plonski
D616,568 S 5/2010 Desrosiers
D627,095 S 11/2010 Miyairi
D649,684 S 11/2011 Trzesniowski
D649,685 S 11/2011 Trzesniowski
D649,686 S 11/2011 Trzesniowski
D649,687 S 11/2011 Trzesniowski
D649,688 S 11/2011 Trzesniowski
D649,693 S 11/2011 Trzesniowski
8,061,865 B2 11/2011 Piepgras
D651,739 S 1/2012 Trzesniowski
D652,568 S 1/2012 Trzesniowski
D652,569 S 1/2012 Trzesniowski
D652,985 S 1/2012 Trzesniowski
D652,986 S 1/2012 Trzesniowski
8,177,385 B2 * 5/2012 Porciatti ..... E04B 9/006 362/147
D662,255 S 6/2012 Klu
D662,256 S 6/2012 Klu
D662,653 S 6/2012 Hochman
8,459,824 B1 6/2013 Esmailzadeh
D782,104 S 3/2017 Klus
D782,106 S 3/2017 Porciatti
9,746,142 B2 * 8/2017 Narendran ..... F21K 9/64
9,879,850 B2 1/2018 Porciatti
9,883,267 B2 1/2018 Porciatti
D818,186 S 5/2018 Trzesniowski
D818,187 S 5/2018 Trzesniowski
D818,188 S 5/2018 Trzesniowski
2003/0021116 A1 1/2003 Miller
2003/0081419 A1 5/2003 Jacob
2004/0095771 A1 * 5/2004 McDonald ..... F21V 7/0016 362/346
2004/0213003 A1 * 10/2004 Lauderdale ..... E04B 9/006 362/404
2005/0152132 A1 7/2005 Bernhart
2006/0262521 A1 11/2006 Piepgras
2008/0266843 A1 10/2008 Villard
2009/0147504 A1 6/2009 Teeters
2009/0316391 A1 12/2009 Huang
2011/0058376 A1 3/2011 Lin
2011/0075416 A1 3/2011 Chou
2011/0080746 A1 4/2011 Patti
2011/0103043 A1 5/2011 Ago
2011/0222270 A1 9/2011 Porciatti
2013/0039042 A1 * 2/2013 Kotovsky ..... F21S 6/007 362/147
2013/0323950 A1 12/2013 Gingrich, III
2014/0268755 A1 * 9/2014 Kotovsky ..... F21S 6/007 362/235
2016/0076746 A1 3/2016 Porciatti
2017/0356603 A1 * 12/2017 Narendran ..... F21S 8/06
2018/0128475 A1 5/2018 Porciatti

* cited by examiner

INDIRECT LED LIGHTING SYSTEM FOR A SUSPENDED CEILING

FIELD OF THE INVENTION

The following invention relates to T-bars and other supports for ceiling tiles within a dropped ceiling (also referred to as a suspended ceiling) above an interior space of a building. More particularly, this invention relates to T-bars and other supports for suspended ceilings which include lighting therein, and most particularly, lighting which shines upwardly against a reflective surface for redirecting of the light down into the interior space beneath the suspended ceiling to provide indirect lighting.

BACKGROUND OF THE INVENTION

Placing lights within T-bars which are also used to suspend ceiling tiles for a "dropped ceiling" is a known lighting option, such as disclosed in U.S. Pat. No. 8,177,385, incorporated herein by reference in its entirety. Such lighting typically utilizes LED lighting technology to have a relatively bright but low power light provided from a relatively small space within a lower portion of the T-bar which is exposed below ceiling tiles supported by the T-bar.

One goal of lighting an interior space is to provide as much light as necessary, without having the light sources ever shining directly into the eyes of individuals within the interior space. When prior art ceiling mounted lighting shines down on an interior space, an individual looking up at the ceiling will have the light shining directly into the individual's eyes. This is not entirely desirable, as it can be blinding to the individual and make it hard to see within an interior space.

Some lighting is noted in the prior art to be indirect, generally with light sources on a pedestal resting on the ground, or otherwise mounted in a manner spaced away from the ceiling, and then shining upward at the ceiling and upper portions of walls, and providing the ceiling and/or walls either white or sufficiently light in color that they reflect much of the light back into the room, but without blinding intensity. Such indirect lighting can be advantageous, but typically impacts on the usefulness of the interior space, in that the indirect lighting shining up at the ceiling takes up some space that could otherwise be utilized beneficially for other purposes. Accordingly, a need exists for providing indirect lighting within an interior space without taking up any of the interior space that could be otherwise utilized.

SUMMARY OF THE INVENTION

With this invention, indirect lighting is provided which is integrated into a T-bar or similar support structure which is also provided for supporting ceiling tiles or other ceiling elements within a ceiling, and most typically a suspended ceiling (also referred to as a dropped ceiling). The indirect lighting T-bar typically has an elongated spine extending between ends thereof, the ends configured so that they can connect to adjacent T-bars. A rest shelf is optionally but preferably provided which is spaced below an upper end of the spine and extending at least partially laterally. Edges of ceiling tiles are supported upon these rest shelves or other supports.

The spine and rest shelf can be formed together as an extruded element, such as from aluminum or other sufficiently high strength material. A lighting module or other body supports a lighting source thereon and is suspended beneath the spine or other elongate support. This lighting source is oriented upwardly. A reflective surface is also provided, adjacent to a lower end of the spine or other elongate support and below any rest shelf or other ceiling tile edge support. This reflective surface is preferably located upon a reflector plate, such as having an under surface which acts as at least part of the reflective surface facing the lighting source. The lighting source thus reflects light off of the reflective surface and indirectly into the interior space beneath the ceiling.

In one embodiment, the reflector plate supports the reflective surface and also doubles as at least a portion of a rest shelf or other support element for supporting the edges of ceiling tiles thereon. In another embodiment, a rest shelf separate from the reflector plate acts as a support for supporting edges of ceiling tiles thereon. As a further option, a combination of both a rest shelf and the reflector plate can act together to support edges of ceiling tiles, particularly when the ceiling tile edges are notched so that they present two separate lower surfaces at different heights which match a spacing between the rest shelf and the reflector plate.

The reflector plate is typically oriented horizontally when the ceiling is to be oriented horizontally, and is adjacent to but just beneath the ceiling tiles which are resting upon and carried by the T-bar to which the reflector plate is attached. A central portion of this reflector plate can be provided with facets which angle downwardly slightly as they extend toward a central plane of the T-bar. This way, lighting extending straight up from the lighting source is not reflected straight back down into the lighting source, but rather is directed laterally somewhat to provide further indirect lighting into the interior space beneath the dropped ceiling. The reflector plates are preferably formed as an extrusion along with the spine and rest shelf, and thus exhibits a substantially constant cross-sectional form. The reflector plate does not need to extend entirely between the ends of the T-bar, but could be provided on only portions of an under side of the T-bar, such as concentrated at one end or concentrated in a middle portion thereof and spaced from each end.

The lighting module or other lighting source supporting body is suspended beneath the T-bar by a suspension element which in one embodiment is a pair of legs extending down from upper portions of the T-bar or other elongate linear ceiling support member to the lighting module. In this embodiment, one leg is provided at each end of the lighting module. The lighting source with lighting module thus has nothing between itself and the reflector plate, other than optionally a diffuser to protect the lighting source, keep dirt from coming directly into contact with the lighting source, and, if desired, to some extent diffuse light from the lighting source, before it continues up to the reflector plate for redirection into space beneath the ceiling. Wiring delivering electric power to the lighting source, such as an LED mounted upon a printed circuit board, can be routed through at least one of these legs, so that such wiring can be hidden from view. The wiring leads to a DC power supply located above the ceiling tiles, such as mounted to an upper end of the spine.

OBJECTS OF THE INVENTION

Accordingly, an object of one embodiment of the present invention is to provide indirect lighting within an interior space beneath a suspended ceiling, without taking up any useful space within the interior space for the indirect lighting.

Another object of one embodiment of the present invention is to provide indirect lighting beneath a suspended ceiling, which indirect lighting is suspended from the suspended ceiling system itself.

Another object of one embodiment of the present invention is to provide lighting within an interior space which avoids directly shining into eyes of an individual within the interior space.

Another object of one embodiment of the present invention is to provide lighting within an interior space mounted to a ceiling and which has an attractive appearance and minimizes size and appearance of lighting related structures associated with the ceiling.

Another object of one embodiment of the present invention is to provide a T-bar which both holds up ceiling tiles within a dropped ceiling and also provide lighting therefrom.

Another object of one embodiment of the present invention is to provide lighting for an interior space which can be easily installed.

Another object of one embodiment of the present invention is to provide a method and lighting unit for easily retrofitting an interior space with additional indirect lighting.

Another object of one embodiment of the present invention is to provide lighting beneath a dropped ceiling in an interior space which lighting is largely hidden from view.

Other further objects of the present invention will become apparent from a careful reading of the included drawing figures, the claims and detailed description of the invention.

DESCRIPTION OF THE PREFERRED EMBODIMENT

Figure 1:
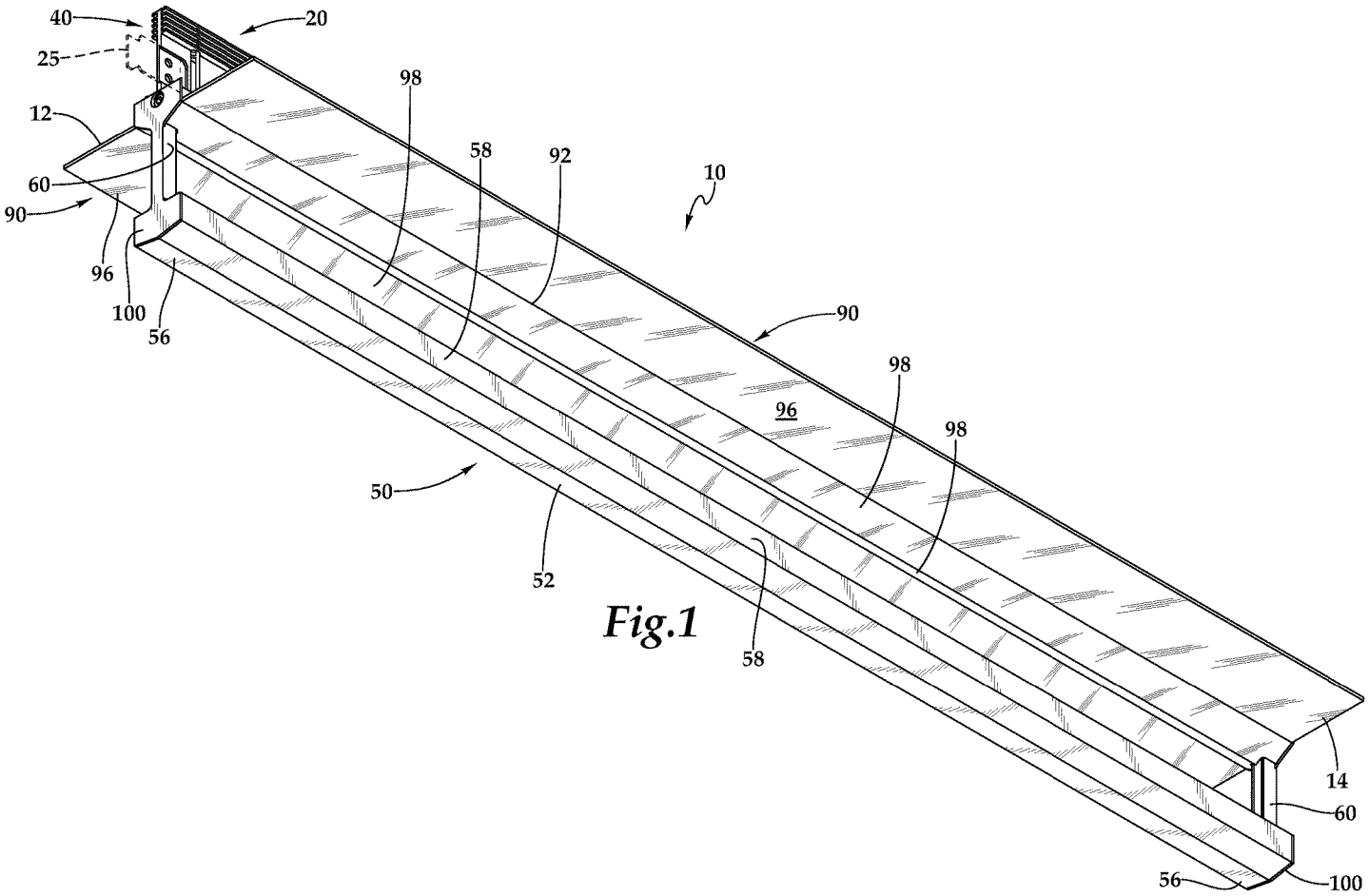
FIG. 1 is a perspective view from below of an indirect lighting T-bar according to one embodiment of this invention, and with a connector for attaching the T-bar to adjacent structures shown in broken lines.

Referring to the drawings, wherein like reference numerals represent like parts throughout the various drawing figures, reference numeral 10 is directed to an indirect lighting T-bar (FIG. 7) which acts to both hold up ceiling tiles C (FIG. 6) or other ceiling components, such as within a dropped ceiling, and also provides lighting of an indirect variety, from a lighting source 80 (FIG. 6) and indirectly reflecting off of a reflector plate 90 and into an interior space beneath the ceiling tiles C. By integrating the lighting source 80 into the T-bar 10, the lighting source 80 is provided beneath a suspended ceiling without requiring separate lighting units within an interior space beneath the ceiling.

Figure 2:
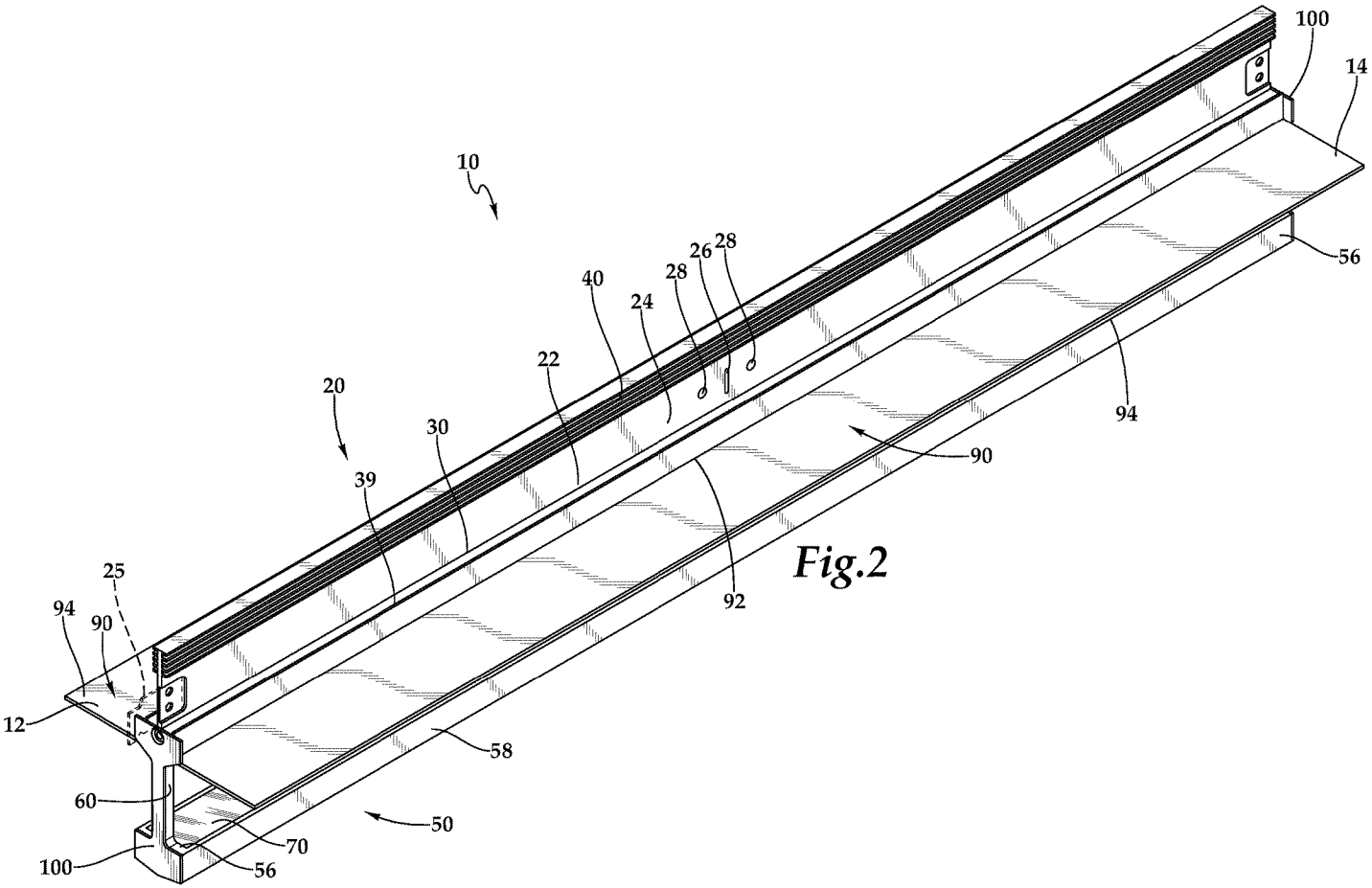
FIG. 2 is a perspective view from above of that which is shown in FIG. 1.
Figures 3, 4, 5:
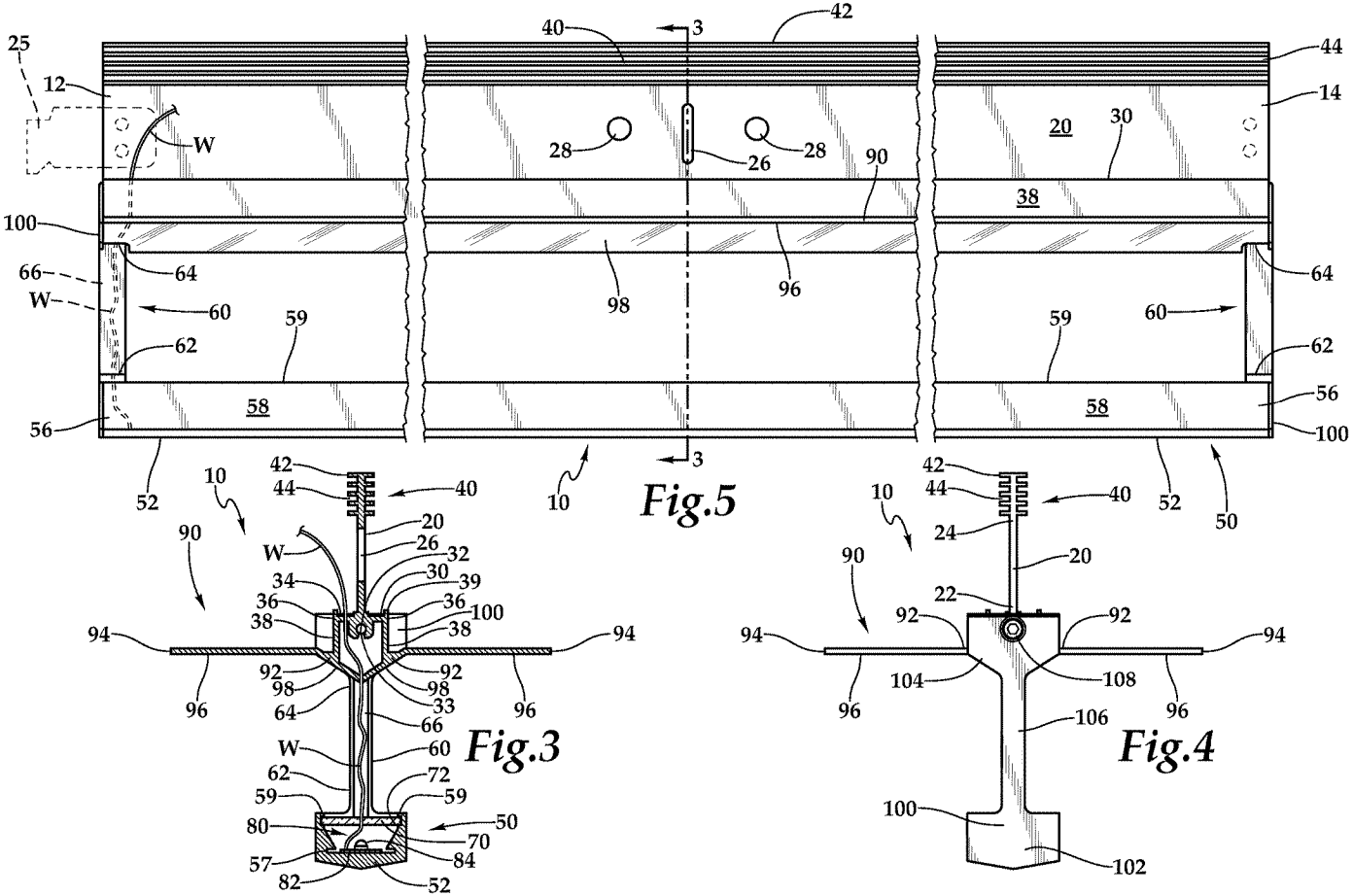
FIG. 3 is a full sectional view of that which is shown in FIG. 1.
FIG. 4 is an end elevation view of that which is shown in FIG. 1.
FIG. 5 is a front elevation view of that which is shown in FIG. 1, and with two intermediate sections removed to allow for enlargement of remaining portions thereof.

In essence, and with particular reference to FIGS. 1-3, basic details of this invention are described, according to an exemplary embodiment. The indirect lighting T-bar 10 includes a spine 20 which is of elongate linear form extending between a first end 12 and a second end 14 of the T-bar 10. A lower end 22 of the spine 20 supports a rest shelf 30 extending laterally from the lower end 22 of the spine 20. The rest shelf 30 supports ceiling tiles C or other portions of the ceiling resting thereon. Portions of the rest shelf 30 or spine 20 extend further down below the rest shelf 30 and support a reflector plate 90 extending laterally beneath the rest shelf 30. In one embodiment, the reflector plate 90 acts along with the rest shelf 30, or in place of the rest shelf 30, to support edges of ceiling tiles C thereon.

A lighting module 50 is suspended beneath the spine 20 and other portions of the T-bar 10. In this embodiment, such suspension of the lighting module 50 is by legs 60 extending down from upper portions of the T-bar 10 to the lighting module 50. A lighting source 80 is provided within the lighting module 50, with this lighting source 80 pointed at least partially upwardly. Light out the lighting source 80 that reflects off of the reflector plate 90 and down into interior space beneath the ceiling tiles C. A diffuser 70 optionally but preferably covers the lighting source 80. End caps 100 can cover portions of the T-bar 10 adjacent to the first end 12 and second end 14.

More specifically, and with continuing reference to FIGS. 1-3, as well as FIG. 5, particular details of the spine 20, rest shelf 30 and a heat sink 40 at an upper end 24 of the spine 20, are described according to this exemplary embodiment, providing structural portions of the T-bar 10 (which is also referred to generally as an elongate linear member) above the reflector plate 90, lighting module 50 and lighting source 80.

The spine 20 and rest shelf 30 are preferably formed together as an extrusion having a constant cross-sectional form. Most preferably, the spine 20 and rest shelf 30 are formed of aluminum, or other material which can be readily extruded and has appropriate strength characteristics and other characteristics to allow it to effectively support ceiling tiles C or other portions of the ceiling within an interior space, typically within a horizontal plane above the interior space.

The spine 20 is preferably a planar structure which extends within a vertically oriented central plane in a typical installation where a ceiling including ceiling tiles C or other ceiling components (FIGS. 10 and 11) is to be oriented horizontally. The spine 20 is elongate between ends of the T-bar 10, and of a thin planar form between a lower end 22 opposite an upper and 24. The lower end 22 is joined to the rest shelf 30, such as at a junction mass 32. The upper end 24 is typically a free end which is suspended from above, such as by having wires anchored above the T-bar 10 and extending down to and connecting to portions of the spine 20. As an alternative, the spine 20 can be supported in position having ends of the T-bar 10 fitted with connectors 25 (FIGS. 1, 2 and 5) which can attach to adjacent T-bars T (FIG. 7), such as through slots 28 (FIGS. 2 and 5) also formed in such T-bars T.

The spine 20 includes at least one such slot 24, such as with one vertically oriented slot at a midpoint between ends of the T-bar 10, and preferably with holes 28 on either side of such slots 26. The slots 26 can receive connectors 25 of other T-bars 10, T, so that the angled lighting T-bar 10 of this invention can totally function as a non-lit standard T-bar 10, and additionally includes the lighting source 80 and associated features for indirect lighting to emanate from the T-bar 10.

While in this embodiment a single slot 26 is provided at a central point on the spine 20, with holes 28 adjacent thereto, such slots 26 could be located in different numbers and at different locations between ends 12, 14 of the T-bar 10 and passing through the spine 20. The holes 28 provide one location where wires or other suspension elements can attach to the T-bar 10 and then be supported from above, so that such wires passing through the holes 28 act as an anchor for the spine 20 and associated T-bar 10 at a desired height within the interior space bounded by the ceiling tiles C, which are supported upon the T-bar 10. The spine 20 can have other forms in other embodiments, with this spine 20 configuration being one configuration which is effective for providing the indirect lighting T-bar 10 of this invention.

The rest shelf 30 is a planar structure which is preferably perpendicular to the spine 20, or perpendicular to a central plane if there is no spine 20 and coupled to the lower end 22 of the spine 20 (or other upper portions of the T-bar 10), such as at the junction mass 32. The rest shelf 30 has an upper surface 34 on the side facing the spine 20 and typically facing upward when the T-bar 10 is supporting a horizontal ceiling.

The rest shelf 30 includes ends 36 at opposite lateral extremities thereof. A wiring hole 37 (FIGS. 3 and 5) preferably passes through the rest shelf 30 at various locations (such as near ends of the T-bar 10), which allow for wiring W providing electric power to the lighting source 80 to pass through the rest shelf 30 and into the recess in the lighting module 50 beneath the rest shelf 30.

At least one fin 39 optionally extends upward from the rest shelf 30. The fin 39 can aid in heat transfer away from the lighting module 50 that may pass up the legs 60 somewhat and up to above the rest shelf 30, so that heat is carried by conduction out of the interior space bound by the ceiling. Often such interior space beneath the ceiling is air-conditioned space which is desired to be kept at a lower temperature than surrounding spaces. The lighting source 80 can generate significant heat when it is in operation. Rather than allowing this heat to pass into the interior space and then relying on air conditioning systems to remove that heat from the interior space, with this invention, the heat is at least partially removed from the interior space initially, so that heat associated with the lighting source 90 does not need to be totally removed by air-conditioning systems which are conditioning the interior space. While the rest shelf 30 is shown with this particular configuration, other forms for the rest shelf 30 could alternatively be provided according to variations which are within the scope of this invention and provide a basic example of providing a ceiling tile edge support function.

Figure 6:
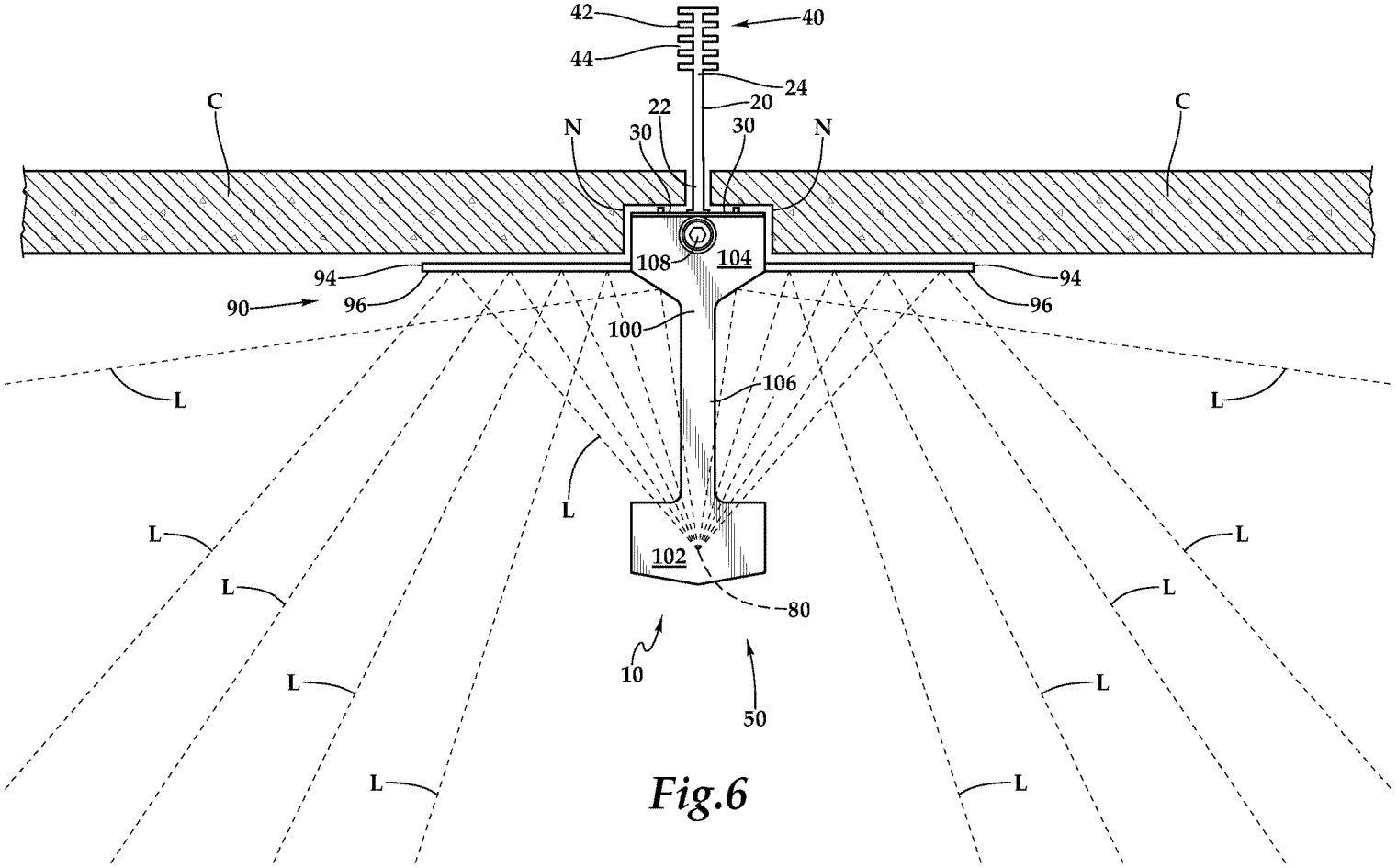
FIG. 6 is an end elevation view of that which is shown in FIG. 4, and with light rays illustrated emanating from the lighting source associated with the indirect lighting T-bar of this embodiment, the light shown reflecting off of a reflector plate of the T-bar and into an interior space beneath a ceiling, and with ceiling tiles shown supported by the T-bar as well.
Figure 7:
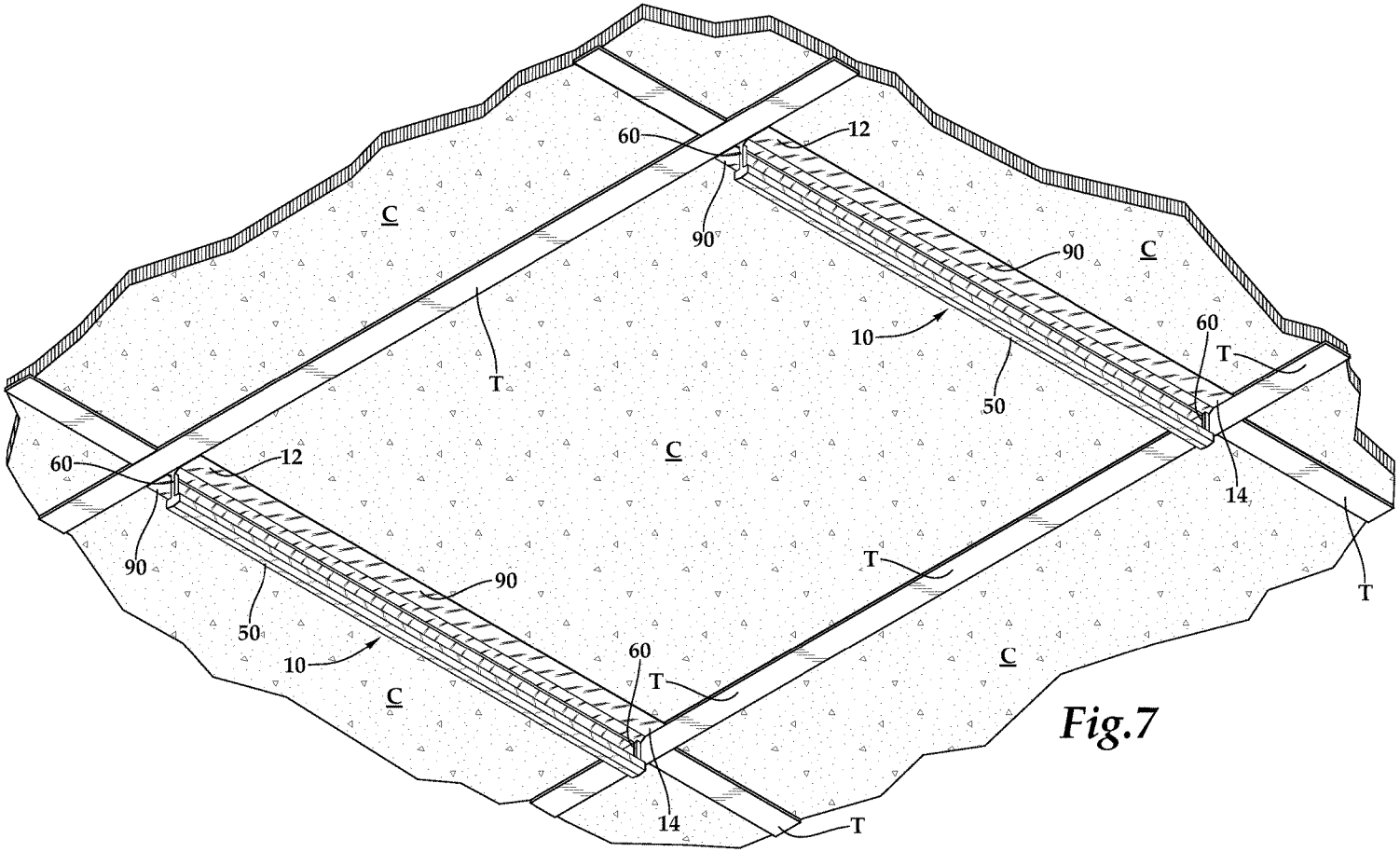
FIG. 7 is a perspective view from below of a suspended ceiling, with the indirect lighting T-bar of FIG. 1 shown installed into the suspended ceiling.

The heat sink 40 is optionally but preferably provided at the upper end 24 of the spine 20. This heat sink 40 has a series of alternating fins 42 with gaps 44 therebetween. The fins 42 and gaps 44 provide surface area through which conduction and convection heat transfer can most effectively happen, at a space entirely above the ceiling tiles C of the ceiling (FIG. 6). In this way, much of heat generated by the lighting source 90 is efficiently directed above the ceiling tiles C. The heat sink 40 could have a greater or lessor number of fins 42 and the fins 42 could be a varying lengths and angles, with the heat sink 40 shown providing one example.

With particular reference to FIGS. 1-3 and 5, details of the lighting module 50 are described, according to this exemplary embodiment. The lighting module 50 provides one form of body suspended beneath upper portions of the T-bar 10, including the spine, rest shelf 30 and reflector plate 90. The lighting module 50 supports the lighting source 80 in an orientation to shine up and reflect off of the reflector plate 90. The lighting module 50 can itself be extruded, but typically is a separate extrusion from that which forms the spine 20, rest shelf 30, heat sink 40 and reflector plate 90. It is conceivable that a single extrusion could extrude the lighting module 50 along with upper portions of the T-bar 10, and then portions, such as a gap between the legs 60 could be cut away. However, typically the lighting module 50 is formed separately from upper portions of the T-bar 10 and then coupled thereto through a methodology such as welding, adhesive bonding, or utilization of mechanical fasteners (rivets, screws, clamps, etc.) to couple the lighting module 50 to upper portions of the T-bar 10. Typically, such coupling and support of the lighting module 52 to upper portions of the T-bar 10 occurs through the legs 60 described in detail below.

The lighting module 50 preferably has a substantially constant cross-sectional form particularly depicted in FIG. 3. Generally, the lighting module 50 is of a "U" shape with an open upper end. The lighting module 50 includes a lower wall 52 with sidewalls 58 extending upward from each end of the lower wall 52. End plates 56 preferably span between the sidewalls 58 at each end of the T-bar 10 or other elongate linear members, so that the lighting module 50 interior recess can only be accessed from above. Similarly, light can only emanate out of the lighting module 50 out of an open top portion of the lighting module 50. The recess within the interior of the lighting module 50 is defined as a space between the sidewalls 58 and between the end plates 56 and above the lower wall 52. This recess can support the lighting source 80 therein.

Preferably, the lighting source 80 is a series of LEDs 84 mounted to a printed circuit board ("PCB") 82. PCB 82 is preferably elongate and thin, fitting with in the bottom of this recess with in the lighting module 50, and adjacent to an upper surface of the lower wall 52. Slots 57 are preferably provided within the recess and at a junction between the lower wall 52 and the sidewalls 58. The slots 57 can retain edges of the PCB 82, so that the LEDs 84 on the upper surface of the PCB 82 are held in fixed position facing upwardly away from the PCB 82 and away from the lower wall 52 of the module 50. The LEDs 84 are preferably high intensity LEDs spaced apart from each other with a regular spacing, such as approximately one every two inches, for example. Interior surfaces of the sidewalls 56 are preferably formed to be reflective, to further assist in directing light out of the lighting module 50 and up towards the reflector plate 90.

A diffuser 70 preferably overlies an opening into the lighting module 50. This diffuser 70 has opposing edges 72 which are each adjacent one of the sidewalls 58. Upper portions of the side walls 58 preferably are defined by lips 59. These lips 59 preferably extend toward each other slightly, with lower portions of the sidewalls 58 tending to taper outwardly as they extend upwardly, so that a small area of maximum width between the sidewalls 58 can be dimensioned to match a width of the diffuser 70 between the edges 72. The diffuser 70 can thus be held in place adjacent to these lips 59. The diffuser 70 protects the lighting source 80 from being contacted, such as by flying insects, dust, etc. The upper surface of the diffuser 70, preferably being substantially flat, can be easily periodically cleaned of any dust or debris collecting thereon. The diffuser 70 is preferably transparent with all of the light from the lighting source 82 beneficially passed therethrough. As an option, the diffuser 70 can have some degree of diffusing character and translucency, rather than strict transparency, such as to absorb certain wavelengths of light if desired, or to otherwise modify light emanating from the lighting source to match preferred lighting for the interior space to be lit by the invention described herein.

Wiring W is coupled to the PCB 82 and provides electric power to the PCB 82 and to the LEDs 84, so that they can cause light L to emanate therefrom. This wiring W (FIGS. 3 and 5) is preferably routed through one of the legs 60 and up to upper portions of the T-bar 10 (and typically to a DC power supply), so that the wiring W can remain hidden from view.

The legs 60 (FIGS. 1, 2 and 5) extend, preferably vertically, between the lighting module 50 and upper portions of the T-bar 10. Thus, preferably two such legs 60 are provided, one adjacent the first end 12 and one adjacent the second end 14. As an alternative, it is conceivable that a single leg 60 could be provided, such as at a central location between the ends 12, 14 of the T-bar 10, or more than two legs 60 could be provided at various different locations between the lighting module 50 and upper portions of the T-bar 10.

By having a leg 60 at each end 12, 14 of the T-bar 10 (or other light bearing elongate linear member), space above the lighting module 50 is essentially entirely open. Thus, light L emanating from the LEDs 84 or other light producing element(s) within the lighting source 80, and preferably passing through the diffuser 70, does not encounter any other obstructions before impinging upon the reflector plate 90. The light L is then reflected downward as indirect lighting into the space beneath the dropped ceiling (FIG. 6).

The legs 60 are in this embodiment shown as a C-shaped channel which is open on inwardly facing sides thereof. As an alternative, the legs 60 could be complete tubes, or could be in the form of parallel plates and rely on the end caps 100 to close outer portions thereof. Each leg 60 is preferably an elongate linear structure oriented vertically and extending between a bottom end 62 and a top end 64. The bottom end 62 is adjacent to the lighting module 50 and the top end 64 is adjacent to central portions of the reflector plate 90 or other upper portions of the T-bar 10.

The legs 60 are preferably separately formed and then fastened to upper portions of the T-bar 10 and to the lighting module 60, such as by bonding, welding, utilizing adhesive, or some form of fasteners therebetween. As an alternative, the legs 60 could be formed with other portions of the T-bar 10 and then bent into the final form such as that depicted herein.

With particular reference to FIGS. 1-3 and 6, details of the reflector plate 90 are described, according to this exemplary embodiment. Reflector plate 90 provides a preferred form of structure for carrying a reflective surface so that light from the lighting source 80 can be redirected and provide indirect lighting within a space beneath a dropped ceiling. This reflective surface is preferably provided at least partially on an undersurface 96 of the reflector plate 90. As an alternative, the reflector plate 90 could merely be a portion of the rest shelf 30 with the reflective surface defining an under portion of this rest shelf 30. Similarly, the rest shelf 30 could be eliminated and the reflective surface could act as a rest shelf to support edges of adjacent ceiling tiles C. As a further option, the reflector plate 90 could at least partially be provided with reflective tape or other reflective material included upon an undersurface of the ceiling tiles C or other ceiling components adjacent to the T-bar 10, either in place of the reflector plate 90 or to augment the reflector plate 90.

Reflector plate 90 is preferably a linear planar structure which extends horizontally or otherwise within a plane aligned with the ceiling tiles C, but could have an angle that varies somewhat from being strictly parallel with the ceiling tiles C. Reflector plate 90 includes a root 92 affixed to adjacent upper portions of the T-bar 10 or other light bearing elongate linear member, and extending out to tips 94 which define free ends of the reflector plate 90. Portions of the reflector plate 90 between the roots 92 and the tips 94 are preferably substantially planer and perpendicular to the spine 20 (or a central plane of the T-bar 10, if the T-bar 10 includes structures other than the spine 20 from which the reflector plate 90 is carried).

Facets 98 extend away from the roots 92 in a direction generally opposite the direction extending to the tips 94, with the facets 98 extending toward a central plane of the T-bar 10 inwardly and slightly downward, until they come together at the central plane directly above the lighting source 80. This junction is preferably in the form of a bevel, so that light L striking one of the facets 98 is either reflected laterally in a first lateral direction or a second lateral direction, but not directly back down at the lighting source 80.

The facets 98 are preferably provided with a reflective surface as well as the undersurface 96 on other portions of the reflector plate 90, but with the undersurface 96 between the root 92 and tips 94 typically being perpendicular to the central axis of the T-bar 10. FIG. 6 depicts one example of pathways for lighting L first extending mostly upwardly from the lighting source 80, and then reflecting off of either the under surface 96 of the reflector plate 90 or the facets 98 other reflector plate 90 and then downwardly at least partially, to provide indirect lighting into the interior space beneath the ceiling.

The roots 92 of the reflector plate 90 are adjacent to end walls 38 of the rest shelves 30, and particularly lower ends of the end walls 38, which extends down from the ends 36 of the rest shelf 30. Preferably in this embodiment, the spine 20, rest shelves 30, end walls 38 and various contours of the reflector plate 90 are all formed together as a single extrusion and defining upper portions of the T-bar 10. The lighting module 50 and structures carried thereby define a lower portion of the T-bar 10. The legs 60 join the lower portions of the T-bar 10 to the upper portions of the T-bar 10. While the rigid legs 60 are provided as a preferred form of suspension element for carrying the lighting module 50 beneath the upper portions of the T-bar 10, other structures such as strings, chains, or other flexible elements could alternatively be utilized (or the wiring W itself could conceivably be utilized).

Figure 8:
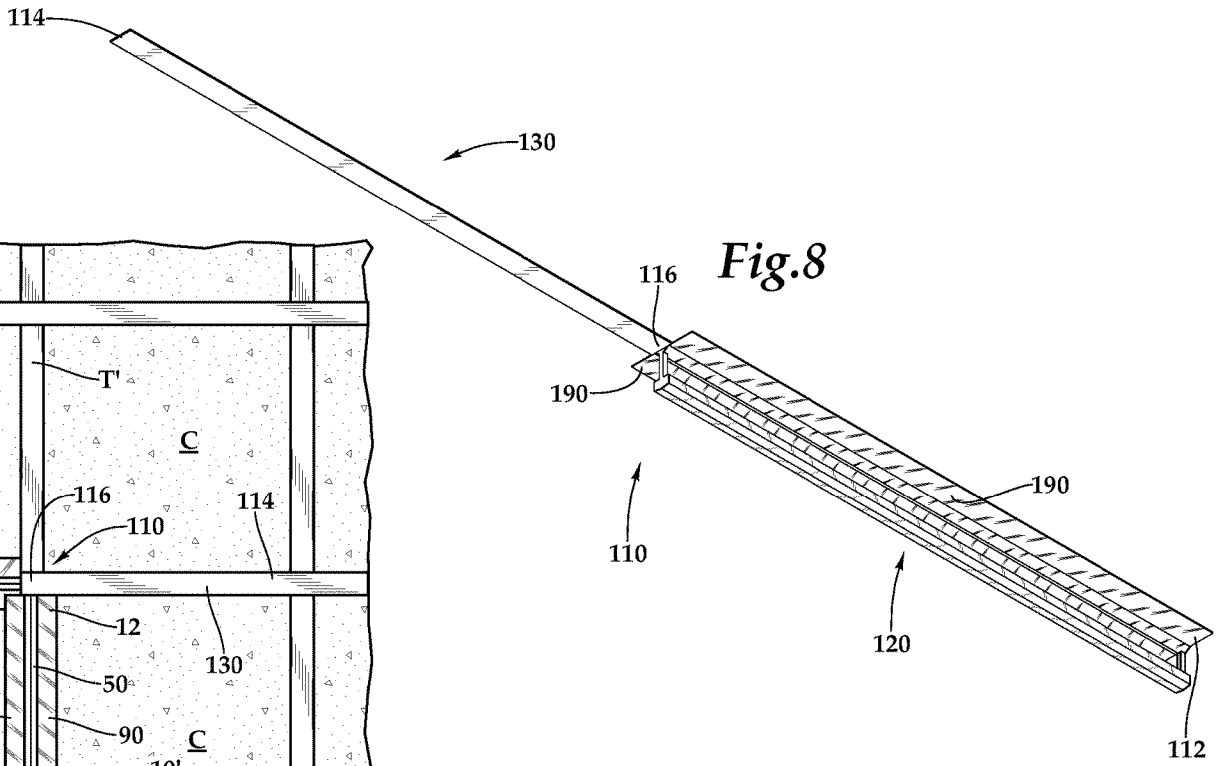
FIG. 8 is a perspective view of an alternative embodiment of that which is shown in FIG. 1, depicting a partially lit indirect lighting T-bar with lighting at only one end thereof.
Figure 9:
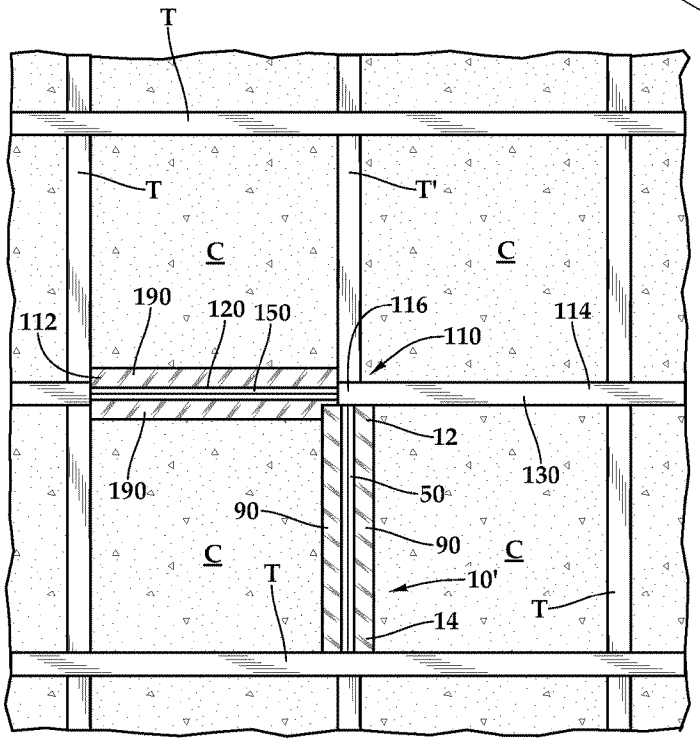
FIG. 9 is a bottom plan view of a portion of a suspended ceiling with the partially lit indirect lighting T-bar of FIG. 8 showed therein, along with a shorter version of the T-bar of FIG. 1 shown therein, and with ceiling tiles supported by a combination of these indirect lighting T-bars and non-lit T-bars.

With particular reference to FIGS. 8 and 9, details of an alternative embodiment partially lit indirect lighting T-bar 110 are described. This partially lit indirect lighting T-bar is in some respects similar to the partially lit bar described in detail in co-pending U.S. patent application Ser. No. 14/948,803, filed on Nov. 23, 2015, and having Publication No. 2016/0076746, incorporated by reference in its entirely.

The partially lit indirect lighting T-bar 110 has a lit portion 120 and an unlit portion 130. The T-bar 110 extends between a first end 112 and a second end 114. The lit portion 120 is adjacent to the first end 112 and the unlit portion 130 is provided adjacent to the second end 114. The unlit portion 130 preferably merely provides a basic T-bar form, while the lit portion 120 has a configuration similar to that depicted in the indirect lighting T-bar 10 of FIGS. 1-7 (except that typically the overall length of the T-bars 10, 110 are similar, so that the lit portion 120 is approximately half the length of the indirect lighting T-bar 10 of FIGS. 1-7).

The lit portion 120 generally includes a lighting module 150 and reflector plate 190 which act together to provide indirect lighting off of the lit portion 120 of the partially lit indirect lighting T-bar 110. A transition 116 defines a midpoint of the partially lit indirect lighting T-bar 110 where it transitions between the lit portion 120 and the unlit portion 130.

The overall partially lit indirect lighting T-bar 110 can be installed between other T-bars T within a dropped ceiling (FIG. 9). Furthermore, a slot at a midpoint in the partially lit indirect lighting T-bar 110 similar to the slot 26 of the T-bar 10 (FIGS. 2 and 5) can support a short T-bar T' coupled thereto. Also, shorter versions of the T-bar 10' can also attach to the partially lit indirect lighting T-bar 110 and to other T-bars T, so that additional different shapes of lighting and arrangements of lighting within the ceiling can be provided.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A support with integral lighting therein, the support comprising in combination:

an elongate spine having a planar form oriented within a central plane and extending between a first end and a second end and having an upper end above a lower end;

a ceiling tile edge support coupled at least indirectly to said elongate spine and below said upper end of said elongate spine;

a reflective surface coupled to said elongate spine and below said upper end of said elongate spine;

said reflective surface extending at least partially laterally and non-parallel with said spine and facing at least partially downwardly;

a body located below said reflective surface and suspended at least indirectly from said elongate spine;

said body having a lighting source supported thereon; and said lighting source oriented to shine light upwardly at said reflective surface.

2. The support of claim 1 wherein at least one leg is located between said body and said elongate spine said leg suspending said body at least indirectly from said elongate spine, said leg having a bottom end coupled to said body and a top end coupled at least indirectly to said spine.

3. The support of claim 2 wherein at least two legs are spaced from each other and suspending said body at least indirectly from said elongate spine, and with open space between said at least two legs and between said lighting source and said reflective surface.

4. The support of claim 1 wherein said lighting source includes a plurality of LEDs.

5. The support of claim 4 wherein said a body includes a printed circuit board supported thereon, wherein said lighting source includes a plurality of LEDs mounted to said printed circuit board, wherein at least one leg is located between said body and said elongate spine said leg suspending said body at least indirectly from said elongate spine, said leg having a bottom end coupled to said body and a top end coupled at least indirectly to said spine, and wherein wiring passing to said printed circuit board from above said reflective surface passes at least partially through said at least one leg.

6. The support of claim 1 wherein said ceiling tile edge support includes a rest shelf coupled to a portion of said elongate spine spaced from said upper end thereof, said rest shelf extending laterally in opposite directions away from said elongate spine, said rest shelf located between said upper end of said elongate spine and said reflective surface.

7. The support of claim 1 wherein said reflective surface is an under surface of a reflector plate, said reflector plate including at least one root opposite at least one tip, and with said reflective surface between said root and said tip, said root closer to said elongate spine than said tip, and wherein at least one facet extends from said root in a direction at least partially away from said tip, said facet extending at least partially downwardly as it extends away from said tip, and at an angle non-planar with a plane between said root and said tip.

8. The support of claim 7 wherein said reflector plate and said elongate spine are formed together with a constant cross-sectional form between said first end and said second end from a common extrusion.

9. A suspended ceiling system with lighting, comprising in combination:

a plurality of elongate linear members;

at least one of said elongate linear members being a light bearing elongate linear member extending between a first end and a second end;

a plurality of ceiling tiles having a plurality of edges;

said elongate linear members each having a pair of ceiling tile edge supports spaced on opposite lateral sides of a central plane of said elongate linear members, by a distance from each other at least as great as a spacing between edges of adjacent said ceiling tiles, to allow said elongate linear members to support two adjacent ceiling tiles with edges of said two adjacent ceiling tiles carried upon said pair of ceiling tile edge supports;

a reflective surface on at least one of said light bearing elongate linear members, said reflective surface located below said pair of ceiling tile edge supports and below at least one of said ceiling tiles adjacent to said at least one light bearing elongate linear member;

a body located below said reflective surface and suspended at least indirectly from said at least one light bearing elongate linear support;

said body having a lighting source supported thereon; and said lighting source oriented to shine light upwardly at said reflective surface.

10. The system of claim 9 wherein said light bearing elongate linear member includes an elongate spine having a planar form oriented within said central plane extending upward above said reflective surface and said pair of ceiling tile edge supports.

11. The system of claim 10 wherein said pair of support elements includes upper surface of said reflector plate.

12. The system of claim 10 wherein said pair of ceiling tile edge supports include a rest shelf extending laterally from said central plane of said light bearing elongate linear members, and above a reflector plate having an undersurface with said reflective surface thereon.

13. The system of claim 12 wherein said rest shelf includes at least one fin extending upward from each end of said rest shelf, said fin providing at least a portion of said pair of ceiling tile supports.

14. The system of claim 12 wherein said edges of said ceiling tiles are notched to exhibit a lesser thickness at said edges than at portions thereof spaced from said edges, and with thinner portions of said ceiling tiles adjacent to said edges resting upon said rest shelf, and thicker portions of said ceiling tiles extending at least partially below said rest shelf.

15. The system of claim 9 wherein said reflective surface is planar and parallel with a plane in which said ceiling tiles are oriented, with said reflective surface located below said ceiling tiles.

16. The system of claim 15 wherein said light bearing elongate linear members include a reflector plate having at least one root opposite at least one tip, and with an under surface between said root and said tip, said root closer to said central plane than said tip, and wherein at least one facet extends from said root in a direction at least partially away from said tip, said facet extending at least partially downwardly as it extends away from said tip, and at an angle non-planar with a plane between said root and said tip, said reflective surface including at least a portion of said undersurface and at least a portion of said facet.

17. The system of claim 9 wherein said light bearing elongate linear members include an elongate spine having a planar form oriented within said central plane extending upward above said reflective surface and said pair of ceiling tile edge supports;

wherein said pair of ceiling tile edge supports include a rest shelf extending laterally from said central plane of said light bearing elongate linear members and above a reflector plate having an undersurface with said reflective surface thereon;

wherein said edges of said ceiling tiles are notched to exhibit a lesser thickness at said edges than at portions thereof spaced from said edges, and with thinner portions of said ceiling tiles adjacent to said edges resting upon said rest shelf, and thicker portions of said ceiling tiles extending at least partially below said rest shelf; and wherein at least a portion of said ceiling tiles spaced from said edges of at least two adjacent ceiling tiles rest upon an upper surface of said reflector plate.

18. A T-bar for supporting ceiling tiles in a dropped ceiling, the T-bar comprising in combination:

an elongate spine extending between a first end and a second end;

a pair of ceiling tile edge supports extending laterally from a lower portion of said elongate spine;

a reflective surface below said pair of ceiling tile edge supports and carried by said spine;

a body located below said reflective surface and suspended at least indirectly from said spine;

said body having a lighting source supported thereon; and said lighting source oriented to shine light upwardly at said planar reflective surface.

19. The T-bar of claim 18 wherein said reflective surface is on at least one reflector plate which also provides at least a portion of said pair of ceiling tile edge supports.

20. The T-bar of claim 18 wherein said reflective surface is on a reflector plate separate from and below said pair of ceiling tile edge supports.

* * * * *